US007285039B1

(12) United States Patent
Sung

(10) Patent No.: US 7,285,039 B1
(45) Date of Patent: Oct. 23, 2007

(54) TOOLS FOR POLISHING AND ASSOCIATED METHODS

(76) Inventor: Chien-Min Sung, 64 Chung-San Road, Ying-Ko Factory, Taipei County (TW) 23911

( * ) Notice: Subject to any disclaimer, the term of this patent is extended or adjusted under 35 U.S.C. 154(b) by 0 days.

(21) Appl. No.: 11/543,761

(22) Filed: Oct. 4, 2006

Related U.S. Application Data

(63) Continuation-in-part of application No. 11/357,712, filed on Feb. 17, 2006.

(51) Int. Cl.
*B24B 1/00* (2006.01)

(52) U.S. Cl. ..... 451/56; 451/57; 451/59

(58) Field of Classification Search ..... 451/56, 451/57, 59, 443; 51/295, 307
See application file for complete search history.

(56) References Cited

U.S. PATENT DOCUMENTS

| | | | | |
|---|---|---|---|---|
| 4,712,334 | A | 12/1987 | Ikezaki et al. | |
| 5,645,472 | A | 7/1997 | Nagahashi et al. | |
| 5,879,220 | A | 3/1999 | Hasegawa et al. | |
| 6,022,268 | A | 2/2000 | Roberts et al. | |
| 6,027,659 | A * | 2/2000 | Billett | 216/11 |
| 6,213,856 | B1 * | 4/2001 | Cho et al. | 451/443 |
| 6,354,907 | B1 | 3/2002 | Satoh et al. | |
| 6,582,283 | B2 | 6/2003 | James et al. | |
| 6,632,127 | B1 | 10/2003 | Zimmer et al. | |
| 6,699,106 | B2 * | 3/2004 | Myoung et al. | 451/56 |
| 6,736,709 | B1 | 5/2004 | James et al. | |
| 6,755,719 | B2 | 6/2004 | Yoshida et al. | |
| 6,769,969 | B1 | 8/2004 | Duescher | |
| 6,899,592 | B1 * | 5/2005 | Kojima et al. | 451/6 |
| 6,918,820 | B2 | 7/2005 | Smith et al. | |
| 2005/0020188 | A1 | 1/2005 | Saito et al. | |

* cited by examiner

*Primary Examiner*—Dung Van Nguyen
(74) *Attorney, Agent, or Firm*—Thorpe North & Western LLP

(57) ABSTRACT

Methods for making polishing tools and associated tools are disclosed. In one aspect, a method of making a polishing tool is provided. Such a method may include truing a working surface of a nano-diamond impregnated substrate. The method may further include forming asperities on the working surface with a polycrystalline diamond dresser, where the asperities have a height to distance ratio of from about 1:5 to about 5:1 and where the average asperity diameter is less than about 175 μm.

21 Claims, 4 Drawing Sheets

TOOLS FOR POLISHING AND ASSOCIATED METHODS

RELATED APPLICATIONS

This application is a continuation-in-part of U.S. patent application Ser. No. 11/357,712, filed Feb. 17, 2006, which is hereby incorporated herein by reference in its entirety.

FIELD OF THE INVENTION

The present invention relates generally to polishing tools and associated methods. Accordingly, the present invention involves the chemical and material science fields.

BACKGROUND OF THE INVENTION

Many industries utilize various types of mechanical polishing processes for polishing work pieces. For example, the computer manufacturing industry relies heavily on chemical mechanical polishing (CMP) processes for polishing wafers of ceramics, silicon, glass, quartz, and metals. Such polishing processes generally entail applying the wafer against a rotating pad made from a durable organic substance such as polyurethane. A chemical slurry is utilized that contains a chemical capable of breaking down the wafer substance and an amount of abrasive particles which act to physically erode the wafer surface. The slurry is continually added to the rotating CMP pad, and the dual chemical and mechanical forces exerted on the wafer cause it to be polished in a desired manner.

Of particular importance to the quality of polishing achieved with this method of polishing is the distribution of the abrasive particles throughout the pad. The top of the pad holds the particles by means of fibers or small pores, which provide a friction force sufficient to prevent the particles from being thrown off of the pad due to the centrifugal force exerted by the pad's spinning motion. Therefore, it is important to keep the top of the pad as flexible as possible, to keep the fibers as erect as possible, and to assure that there is an abundance of open pores available to receive newly applied abrasive particles.

One problem that arises with regard to maintaining the pad surface, however, is an accumulation of polishing debris coming from the work piece, the abrasive slurry, and the pad dresser. This accumulation causes a "glazing" or hardening of the top of the pad, mats the fibers down, and thus makes the pad surface less able to hold the abrasive particles of the slurry. These effects significantly decrease the pad's overall polishing performance. Further, with many pads, the pores used to hold the slurry, become clogged, and the overall asperity of the pad's polishing surface becomes depressed and matted. A CMP pad dresser can be used to revive the pad surface by "combing" or "cutting" it. This process is known as "dressing" or "conditioning" the CMP pad. Many types of devices and processes have been used for this purpose. One such device is a disk with a plurality of superhard crystalline particles such as diamond particles attached to a metal-matrix surface.

As semiconductor technology continues toward size reduction to the nano-scale, however, current CMP polishing techniques are proving to be inadequate. With such a reduction in scale, materials utilized to construct circuit elements have become more delicate, both in size and materials. The CMP industry has been required to respond by providing polishing materials and techniques that accommodate these advances. For example, lower CMP polishing pressures, smaller size abrasive particles in the slurry, and polishing pads of a size and nature that do not over polish or damage the wafer must be used. Furthermore, pad dressers that cut asperities in the pad which can accommodate the smaller abrasive particles, and that do not overdress the pad must also be used.

There are a number of problems associated with modifying current CMP processes to accommodate such delicate polishing. With regard to the CMP pad dresser, the superabrasive particles must be significantly smaller than those typically used in currently know dressing operations. Generally speaking, the superabrasive particles are so small that a traditional metal matrix is often unsuitable for holding and retaining them. Further, the smaller size of the superabrasive particles requires that particle tip height be precisely leveled in order to uniformly dress the pad. Traditional CMP pad dressers can have particle tip height variations of more than 50 μm without compromising dressing performance. However, such a variation would render a dresser useless if it were required to dress a CMP pad and achieve polishing of extremely small and delicate circuit elements. In this case, asperities in the dressed pad would have height variations on the same order as the dresser. The highest asperities exert the highest pressure, and would thus scratch and damage the wafer.

In addition to drastic height variations relative to the delicacy of the polishing operation, damage to the wafer can also occur due to the abrasive particles themselves. Sizing of these particles can be problematic, particularly with the smaller sizes required for more delicate polishing operations. Larger abrasive particles that tend to cause surface damage to the wafer are thus difficult to eliminate from the slurry.

As a result, polishing tools that are suitable for delicate polishing applications such as those that have arisen with continual reductions in semiconductor size are being sought.

SUMMARY OF THE INVENTION

Accordingly, the present invention provides methods for making polishing tools, and the corresponding tools. Such a method may include truing a working surface of a nano-diamond impregnated substrate. The method may further include forming asperities on the working surface with a polycrystalline diamond dresser. The formed asperities have a height to distance ratio of from about 1:5 to about 5:1, and the average asperity diameter is less than about 175 μm.

It is contemplated that any method of truing the working surface of the nano-diamond impregnated substrate is considered to be within the present scope. In one aspect, however, truing the working surface may include shaving the working surface with a planer. One such useful planer is a polycrystalline diamond planer.

In an embodiment of the present invention, the height to distance ratio of the asperities may be from about 1:2 to about 2:1. In yet another embodiment, the height to distance ratio may be about 1:1. The present invention encompasses methods wherein the average asperity diameter is less than about 150 μm. Likewise, methods wherein the average asperity diameter is less than about 125 μm and less than about 100 μm are included in the present invention.

Although any polishing tool with a nano-diamond impregnated substrate is contemplated, in one aspect, the substrates may contain less than about 50% nano-diamond. In a further contemplated embodiment, the nano-diamond comprises less than about 25% of the substrate. In yet another embodiment, the nano-diamond comprises less than about 10% of the substrate.

Various organic and inorganic materials are contemplated from which these polishing tools may be made. The nano-diamond impregnated substrate may include organic materials, inorganic materials, and mixtures thereof. In certain aspects, however, the nano-diamond impregnated substrate may include organic material. For example, the nano-diamond impregnated substrate may include urethanes, carbonates, amides, sulfones, vinyl chlorides, acrylates, methacrylates, vinyl alcohols, esters, acrylamide moieties, and mixtures thereof. In another aspect, the nano-diamond impregnated substrate may include inorganic material. For example, the inorganic material may be Al, Cu, Zn, Ga, In, Sn, Ge, Pb, Tl, Cd, Ag, Au, Ni, Pd, Pt, Co, Fe, Mn, W, Mo, Cr, Ta, Nb, V, Sr, Ti, Si, and mixtures thereof.

Nano-abrasive particles may optionally be included to improve the polishing of the work piece. In one aspect, for example, the method may further include applying a slurry having nano-abrasive particles to the working surface. In another aspect, nano-abrasive particles may be disposed within at least a portion of the working surface of the working surface of the substrate. Though any nano-abrasive particle capable of assisting polishing is considered to be within the scope of the claims of the present invention, specific examples may include diamond, boron carbide, cubic boron nitride, garnet, silica, ceria, alumina, zircon, zirconia, titania, manganese oxide, copper oxide, iron oxide, nickel oxide, silicon carbide, silicon nitride, tin oxide, titanium carbide, titanium nitride, tungsten carbide, yttria, and mixtures thereof.

Additionally, the polishing tool may be substantially metal or it may contain various proportions of metal material within the nano-diamond impregnated substrate. For example, in one aspect, the polishing tool may be comprised of at least about 40% metal. In another aspect, the polishing tool may be comprised of at least about 60% metal. In yet another aspect, the polishing tool may be comprised of at least about 90% metal.

Aspects of the present invention additionally include polishing tools made according to the methods disclosed herein.

There has thus been outlined, rather broadly, various features of the invention so that the detailed description thereof that follows may be better understood, and so that the present contribution to the art may be better appreciated. Other features of the present invention will become clearer from the following detailed description of the invention, taken with the accompanying claims, or may be learned by the practice of the invention.

DETAILED DESCRIPTION OF THE INVENTION

Definitions

In describing and claiming the present invention, the following terminology will be used in accordance with the definitions set forth below.

The singular forms "a," "an," and, "the" include plural referents unless the context clearly dictates otherwise. Thus, for example, reference to "a particle" includes reference to one or more of such particles, and reference to "the metal" includes reference to one or more of such metals.

As used herein, "asperity" refers to a protrusion that has been purposefully formed on a surface of a substrate, the protrusion having a well-defined tip at the apex.

Figure 3:
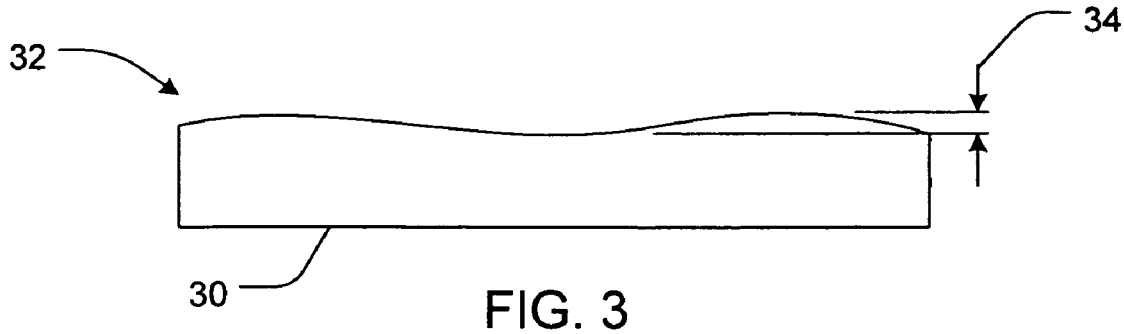
FIG. 3 is a cross-sectional view of a solid substrate in accordance with another embodiment of the present invention.

As used herein, "surface roughness RA" refers to a measure of the roughness of a surface as determined by the difference in height between the highest peak on the surface and the lowest valley on the surface. A depiction of surface roughness RA is shown in FIG. 3 at 34.

Figure 4:
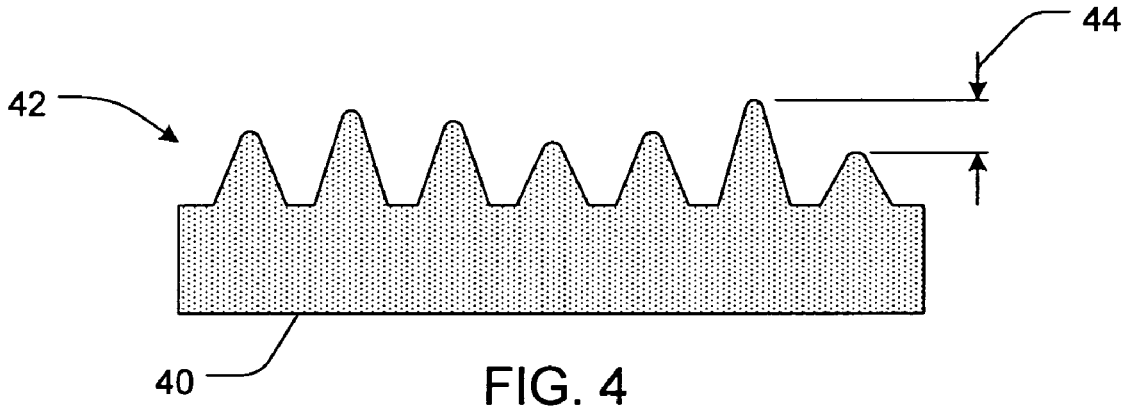
FIG. 4 is a cross-sectional view of a polishing tool in accordance with yet another embodiment of the present invention.

As used herein, "tip-to-tip RA" refers to a measure of the difference in height between the highest asperity tip and the lowest asperity tip. A depiction of tip-to-tip RA is shown in FIG. 4 at 44.

As used herein, "metallic" refers to a metal, or an alloy of two or more metals. A wide variety of metallic materials is known to those skilled in the art, such as aluminum, copper, chromium, iron, steel, stainless steel, titanium, tungsten, zinc, zirconium, molybdenum, etc., including alloys and compounds thereof.

As used herein, "Babbitt alloy" refers to a group of soft metal alloys that are well known in the art. Common nonlimiting types include lead based, lead-silver based, tin based, cadmium based, arsenic based, and various combinations thereof.

As used herein, "ceramic" refers to a hard, often crystalline, substantially heat and corrosion resistant material which may be made by firing a non-metallic material, sometimes with a metallic material. A number of oxide, nitride, and carbide materials considered to be ceramic are well known in the art, including without limitation, aluminum oxides, silicon oxides, boron nitrides, silicon nitrides, and silicon carbides, tungsten carbides, etc.

As used herein, "nano-abrasive" and "nano-particle" may be used interchangeably, and refer to abrasive particles having a size in the nano-range. Size ranges may vary depending on the particular use. In one aspect, however, nano-abrasives may range in size from about 1000 nm to about 1 nm. In another aspect, nano-abrasives may range in size from about 100 nm to about 10 nm. In yet another aspect, nano-abrasives may range in size from about 50 nm to about 20 nm. Such nano-particles may take a variety of shapes, including round, oblong, square, euhedral, etc., and they may be single crystal or polycrystalline.

As used herein, "working surface" refers to a surface of a polishing tool upon which asperities are formed for polishing applications.

As used herein, "impregnate" and "impregnated" refers to a first material having a second material introduced into it, or the act of introducing such. For example, "nano-diamond impregnated" indicates a material having nano-diamond admixed therein. In some aspects, the nanodiamond may occupy pores or spaces within the impregnated material. By way of example without limitation, a material may become impregnated with nano-diamond particles by providing such a material, for example a substrate material as a powder. The substrate powder material is then mixed with nano-diamond particles and melted to form a mixture. The mixture can then be further processed to a solid substrate containing nano-diamond particles. The product of such process is considered to be nano-diamond impregnated. Furthermore, a nano-diamond impregnated substrate may have nano-diamond dispersed evenly throughout the substrate, or may be unevenly dispersed. The nano-diamond may be present throughout the entire substrate, but randomly dispersed. Additionally, the nano-diamond may be present only in the working surface of the substrate. Furthermore, the nano-diamond may have higher concentration towards the working surface of the substrate.

As used herein, "height to distance ratio" in reference to asperities on a working surface refers to the ratio of the average asperity height to the average distance between asperities. The asperity height is measured from the working surface. The distance between asperities is measured from the intersection of the base of the asperity with the working surface to a nearest likewise location on a neighboring asperity. In essence, the distance measurement is the distance of uninterrupted flat (i.e. no asperities) working surface between asperities.

As used herein, "asperity diameter" refers to the measurement of an asperity from the location where the base of the asperity intersects the working surface, directly through the center of the asperity, along the plane of the working surface, and to a location where the base of the asperity intersects the working surface.

As used herein, "average" refers to any mathematical measurement of central tendency. Average includes the arithmetic mean, median or mode. With such small measurements of the present invention, it is understood that averages may not be calculated with precise measurements accounting for each asperity, but may be scientifically estimated as per practices common in the field.

As used herein, "truing" is refers to leveling a surface. The specific tolerances indicated by "truing" depend on the particular material and usage. In the present invention, any leveling or straightening of the working surface that allows for the formed asperities as claimed is to be included. In some embodiments, and under some circumstances, truing may include leveling a working surface to a surface roughness RA value of less than or equal to about 50 μm. In other embodiments, the surface roughness RA value may be less than or equal to about 20 μm. In still other embodiments, the surface roughness RA value may be less than or equal to about 10 μm.

Likewise, the term "pre-trued" refers to a level surface. Specific tolerances indicated by the term again depend on the particular material and usage. In the present invention, a level or straight surface that allows for the formation of the claimed asperities is to be included. In some embodiments, and under some circumstances, a pre-trued working surface may have a surface roughness RA value of less than or equal to about 50 μm. In other embodiments, the surface roughness RA value may be less than or equal to about 20 μm. In still other embodiments, the surface roughness RA value may be less than or equal to about 10 μm.

As used herein, "substantially" refers to situations close to and including 100%. Substantially is used to indicate that, though 100% is desirable, a small deviation therefrom is acceptable. For example, substantially all asperities includes groups of all asperities and groups of all asperities minus a relatively small portion of asperities.

As used herein, the term "about" is used to provide flexibility to a numerical range endpoint by providing that a given value may be "a little above" or "a little below" the endpoint.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc.

This same principle applies to ranges reciting only one numerical value. Furthermore, such an interpretation should apply regardless of the breadth of the range or the characteristics being described.

The Invention

The present invention relates to novel polishing tools and methods for polishing substrates. The inventor has discovered that the scratching of a work piece during polishing may be more of a result of asperity configuration than the hardness of the material from which the polishing tool has been constructed. Accordingly, polishing tools with asperity tips that have been very precisely leveled can be used to effectively polish a surface of a work piece down to the nanometer range even if the tool is made from a very hard material.

Figure 1:
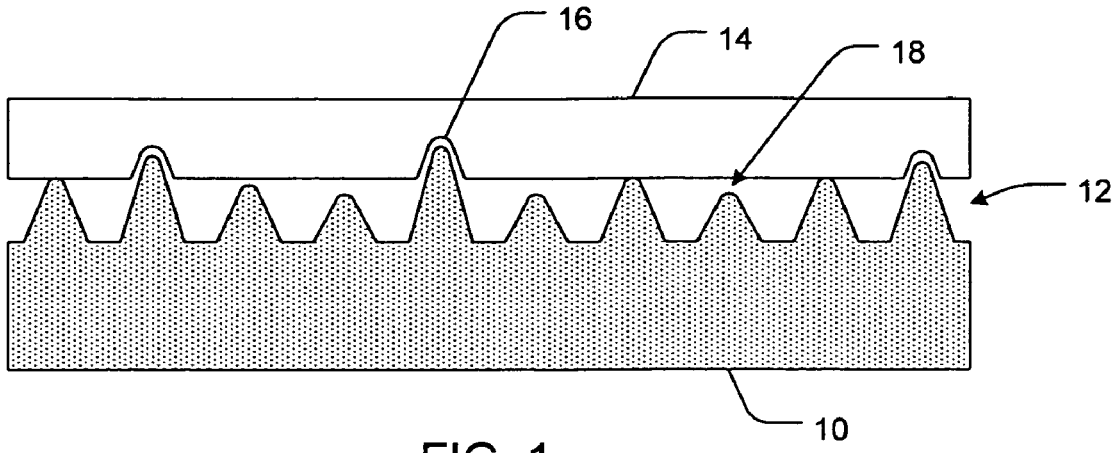
FIG. 1 is a cross-sectional view of a prior art polishing tool.

In the case of CMP polishing, for example, scratching of the wafer is often a result of the non-uniform asperities on the CMP pad. Turning to FIG. 1, for example, a polishing tool 10 is shown having asperities 12 with non-uniform heights. A work piece 14 is shown being polished by the polishing tool 10. Asperities having a greater protrusion from the mean asperity height tend to scratch (shown at 16) the work piece 14. Conversely, those asperities 12 having a lesser protrusion from the mean asperity height may not contact (shown at 18) the work piece 14 and are thus performing little or no work, and possibly even forming high spots on the work piece 14. These effects may occur with polishing tools made from soft as well as hard materials. In the case of soft materials, the scratches may be the result of increased pressure at the more highly protruding asperities.

Figure 2:
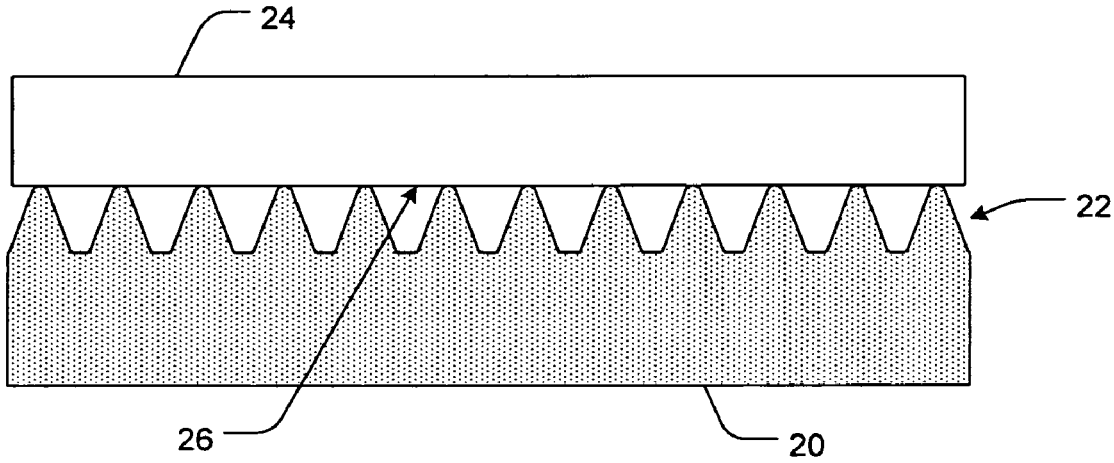
FIG. 2 is a cross-sectional view of a polishing tool in accordance with one embodiment of the present invention.

Accordingly, scratching can be minimized and polishing rates can be increased by precisely leveling the tips of the asperities, regardless of the hardness of the polishing tool. It is thus the variation in asperity configurations causing differential regions of pressure across the polishing surface of the work piece that facilitates scratching, rather than the relative level of hardness of the material from which the polishing tool is constructed. As is shown in FIG. 2, a polishing tool 20 having asperities of a substantially uniform height 22 will contact a work piece 24 evenly across a working surface 26. Such a polishing tool 20 will polish a work piece 24 evenly without the formation of significant scratches and high spots. Polishing rates will be increased with such a polishing tool because essentially all asperities are working to polish the tool, and no single asperity or group of asperities is exposed to a higher workload than any other asperity or group of asperities. Because polishing rate is proportional to pressure, the polishing tool may be constructed from a variety of materials, from hard materials to soft materials.

The precise leveling of the asperities thus allows polishing tools to be constructed from more durable materials that have previously been allowed that can be resurfaced and reused to a much greater extent. Nano-diamond impregnated pads, for example, can be created by forming asperities along the working surface of the tool with a polycrystalline diamond dresser. Additionally, slurries containing abrasive particles are optional with the use of such a tool. The precisely aligned tips of the asperities abrasively polish the work piece in a polishing operation, although various abrasives, chemicals, reduction/oxidation reactions, etc may assist this process.

The polishing tools created through the disclosed methods may have multiple and various uses. It is intended that the scope of use of the tools created according to the disclosed methodologies not be limited to a particular work piece or polishing operation, but that such scope include any type of polishing or abrading for which these tools and techniques would be useful. Examples of work pieces may include, without limitation, wafers, LEDs, laser diodes, mirrors, lenses, memory storage surfaces, integrated circuits or any other structures containing conductive and/or dielectric structures, quartz, glass, metals, semiconductors, etc. Additionally, the range of detail of polishing may vary depending on the material being polished and the desired application of such material.

In one aspect of the present invention, a method of making a polishing tool is provided. Such a method may include truing a working surface of a nano-diamond impregnated substrate. The method may also include forming asperities on the working surface with a polycrystalline diamond dresser. The asperities may have a height to distance ratio of from about 1:5 to about 5:1, and the average asperity diameter may be less than about 175 μm.

Various tools for polishing a work piece are also contemplated that may be made according to methods of the present invention. Any polishing tool having a nano-diamond impregnated substrate with asperities on the working surface of the substrate according to aspects disclosed herein would be considered to be within the present scope. Examples may include, without limitation, CMP pads, grinding disks, fixed abrasive pads, etc.

Work pieces of the present invention include nano-diamond impregnated substrates having a working surface. The working surface has asperities that can effectuate the polishing when the tool is used. Because asperities may be significantly smaller than the average surface roughness of an un-trued working surface, it may be beneficial to true the working surface of the polishing tool prior to forming asperities thereon. FIG. 3 shows a solid substrate 30 having a working surface 32 having a surface roughness RA value, shown at 34. In order to effectively polish a work piece, substantially all asperities along the working surface should contact the interface surface to be polished. High regions of increased surface roughness along the working surface will cause the asperities in that region to press more tightly against the interface surface, thus causing scratching as has been described. Depending on the extent of the surface roughness, asperities in low regions along the working surface may not contact the interface surface, thus further increasing scratching problems. Such non-uniform contact of asperities against the interface surface of the work piece also results in lower polishing rates. As a result, a precisely trued working surface of the polishing tool will reduce the frequency and scale of scratching.

Various methods and tools are contemplated for truing the working surface of the nano-diamond impregnated substrate. Nearly any method of truing the working surface can be used as long as it is capable of creating asperities within the tolerances disclosed herein. The tolerances for the asperity height to distance ratio may vary depending on the intended application and the relative scale of polishing for a given polishing tool. It should be noted that the range of acceptable average asperity diameter values is also necessarily dependent on the intended application and related height to distance ratio. As such, the working surface may be trued to a surface roughness RA value that allows the asperities formed thereon to obtain an acceptable height to distance ratio and average asperity diameter such that the polishing tool may be used to polish the work piece to a desired finish. It would thus be within the ability of one of ordinary skill in the art once in possession of the present disclosure to design a polishing tool having a height to distance ratio and average asperity diameter that is compatible with a desired level of polishing.

In one aspect of the present invention, the working surface may be trued by shaving with a planing tool. The nature and configuration of such a planing tool may depend to some extent on the nature of the work piece and the desired level of polishing. In one specific aspect, however, the planing tool may be a polycrystalline diamond (PCD) planer. The extreme hardness of PCD makes it a good material from which to form a planing tool, particularly with nano-diamond impregnated substrates. Additionally, PCD can be manipulated to form various cutting shapes and configurations. Accordingly, a PCD planer may be constructed by sintering a PCD material such as PCD powder at ultrahigh pressures and high temperatures. The resulting PCD matrix can be carved to a desired planar configuration by any useful method, such as plasma etching, laser ablation, electro discharge machining (EDM), or any other method known to one of ordinary skill in the art. Further details relating to the use of such PCD materials in the construction of planers and other PCD tools, as well as examples of specific tools can be found in the application entitled "Superhard Cutters and Associated Methods" filed on Feb. 17, 2006 under Ser. No. 11/786,426, which is incorporated herein by reference.

Though various height to distance ratios are contemplated depending on the intended application of the polishing tool, in one aspect the ratio value may be from about 1:5 to about 5:1. In another aspect, the ratio value may be from about 1:2 to about 2:1. In yet another aspect, the ratio may be about 1:1.

Likewise, the average asperity diameter values are contemplated depending on the intended application of the polishing tool and the related height to distance ratio. In one embodiment, the average asperity diameter is less than about 175 μm. In another embodiment, the average asperity diameter is less than about 150 μm. In still another aspect, the average asperity diameter is less than about 125 μm. In yet another embodiment, the average asperity diameter is less than about 100 μm.

As has been discussed, precisely leveled asperity tips will improve the polishing characteristics of the polishing tool, and reduce the tip-to-tip RA value of the asperities across the working surface. The lower the tip-to-tip RA value, the finer the polished resolution of the resulting polished surface. As such, it may be beneficial for some applications to CMP process the working surface of the polishing tool prior to forming the asperities thereon. Such CMP processing may result in a finer resolution of polishing than what can be afforded by truing the surface alone.

Once the surface has been trued and optionally CMP processed, the asperities may be formed thereon by any means known to one of ordinary skill in the art, provided that the resulting asperities are leveled to the tip-to-tip RA values as disclosed herein. FIG. 4 shows a polishing tool 40 having asperities 42 formed thereon, and having a tip-to-tip RA value, shown at 44. In addition to asperity leveling, density and patterning of asperities across the working surface may also affect the polishing characteristics of the tool. The polishing rate of a tool may vary in relation to asperity density. On one hand, as asperity density increases, the number of asperities contacting the work piece increases. On the other hand, the pressure exerted by each asperity decreases as the asperity density increases up to a point due to the total force exerted by the polishing tool being divided up across all working asperities. Because polishing rate is related to the area of contact and the exerted pressure between the tool and the work piece, the density of the formed asperities may be adjusted to provide an optimal polishing rate. Accordingly, in one aspect of the present invention, the asperities may be formed on the working surface according to a predetermined pattern.

Various methods are contemplated for forming asperities on the working surface of the solid substrate. In one aspect of the present invention, the asperities may be formed by dressing the working surface with a dressing tool. Dressing tools are well known in the art. However, as has been discussed, current dressing tools are unable to form asperities in a tool surface having tip-to-tip RA values as disclosed herein. As such, dressers having precisely leveled cutting elements are required for forming such asperities. In one specific aspect, such a dressing tool may be a PCD dresser. As has been discussed, the extreme hardness of PCD makes it a good material from which to form a dressing tool. Additionally, PCD can be manipulated to form various cutting elements and cutting element configurations. Accordingly, a PCD dresser may be constructed by sintering a PCD material such as PCD powder at ultrahigh pressures and high temperatures. The resulting PCD matrix can be carved to a desired dresser configuration, including individual cutting elements having very precise projections and orientations. As with the PCD planer, the PCD dresser may be shaped and carved by any useful method, such as plasma etching, laser ablation, electro discharge machining (EDM), or any other method known to one of ordinary skill in the art. Further details relating to the use of PCD materials in the construction of dressers and other PCD tools can also be found in the application entitled "Superhard Cutters and Associated Methods" filed on Feb. 17, 2006 under Ser. No. 11/786,426 which is incorporated herein by reference.

In addition to PCD dressers, other tools having very precisely leveled cutting elements may be utilized to form asperities in the polishing tools of the present invention. For example, superabrasive particles generally cannot be leveled precisely when incorporated into a brazed metal tool due to the movement of the thermal movement of the tool during cooling. Superabrasive particles may, however, be incorporated into tools that utilize a resin or other organic layer as a particle substrate. Examples of such tools may be found in U.S. patent application Ser. Nos. 11/026,544 filed on Dec. 30, 2004, and Ser. No. 11/223,786 filed on Sep. 9, 2005, both of which are incorporated herein by reference.

In one aspect, the polishing tool may contain various proportions of nano-diamond within the substrate. For example, in one aspect, the polishing tool may be comprised of less than about 75% nano-diamond. In another aspect, the polishing tool may be comprised of less than about 50% nano-diamond. In another aspect, the polishing tool may be comprised of less than about 25% nano-diamond. In yet another aspect, the polishing tool may be comprised of less than about 10% nano-diamond.

Various materials are contemplated from which the polishing tools of the present invention may be made. Because the asperities are precisely leveled and substantially all come into contact with the interface surface of the work piece, scratching can be avoided regardless of the hardness of the polishing pad. As such, virtually any material upon which asperities can be formed within the tolerances provided herein, and which can be impregnated with nano-diamond can be utilized to form such polishing tools. Specific polishing tool materials can be chosen by one of ordinary skill in the art depending on the particular application of the tool. For example, as nano-diamond is to be incorporated into the tool, it may be helpful to utilize materials that will readily wet diamond in order to improve retention. Furthermore, if an acid slurry is to be used to assist polishing, it may be useful to select a material that provides resistance to the particular acids include in the slurry. Additionally, the oxide potentials of various materials may also influence which materials are utilized, particularly in those applications involving electrolytic polishing.

Various organic and inorganic materials are contemplated which can be used to construct polishing tools. In certain aspects, however, the polishing tool may be constructed from inorganic materials and thus may be an inorganic polishing tool. In one aspect, the polishing tool may contain various proportions of metal within the solid substrate. For example, in one aspect, the polishing tool may be comprised of at least about 50% metal. In another aspect, the polishing tool may be comprised of at least about 75% metal. In yet another aspect, the polishing tool may be comprised of at least about 95% metal.

As has been discussed, any material capable of having asperities formed thereon within the tolerances specified herein and being impregnated with nano-diamond is considered to be within the present scope. In particular, and without limitation, the polishing tool may include, or consist of a material such as Al, Cu, Zn, Ga, In, Sn, Ge, Pb, Tl, Cd, Ag, Au, Ni, Pd, Pt, Co, Fe, Mn, W, Mo, Cr, Ta, Nb, V, Sr, Ti, Si, and mixtures thereof, including composite materials, polymers, and ceramics.

In one aspect of the present invention the polishing tool may be constructed from a metal having a melting point of less than about 700° C. Such soft metal polishing tools may provide various manufacturing benefits. For example, softer metals are more easily manipulated due to their increased malleability. Asperities may be more easily formed thereon, particularly for those aspects involving cutting the asperities with a dresser. A few nonlimiting exemplary soft metals are shown in Table I, along with their melting temperatures.

TABLE I

| Soft Metal | Melting Point (C°) |
|---|---|
| Al | 660.5° |
| Sb | 630.8° |
| Zn | 420.0° |
| Pb | 327.5° |
| Cd | 325.1° |
| Tl | 304.0° |
| Bi | 271.4° |
| Sn | 232.0° |
| In | 156.6° |
| Ga | 29.8° |

In those aspects where lower melting point metals are to be used in the construction of polishing tools, various alloys may also be utilized. Alloying at least two metals or a metal with a non-metal generally decreases the melting point of the alloy. Such alloys may be binary, ternary, or other multi-component alloys. A few nonlimiting examples of such alloys are shown in Table II. The wt % is provided in Table II for the first named element in the metal alloy.

TABLE II

| Metal Alloy | Wt % | Melting Point (C°) |
|---|---|---|
| Al—Si | 12.6 | 577° |
| Babbitt Alloy | — | 480° |
| Cu—Mg | 60 | 457° |
| Al—Cu | 32 | 548.2° |
| Al—Mg | 15-90 | 437-450° |
| Cu—Zn | 99.3 | 425° |
| Al—Ge | 51.6 | 420.0° |
| Cu—Sn | 99.3 | 227° |
| Al—Sn | 99.4 | 220° |
| Sn—Zn | 91.2 | 198.5° |
| Sn—Tl | 43 | 168° |

One example of a useful metal may include Al, which has a high oxide potential and readily wets diamond. Accordingly, the polishing tool may be substantially solid aluminum, or it may be an alloy thereof. For example, useful alloys may include, without limitation, Al—Si, SiC, and solder alloys such as Sn—Cu—Ag.

An additional benefit of utilizing metal polishing tools is the capability to introduce an electrical bias in the tool to facilitate polishing by electrolytic reactions. So called electrical CMP (ECMP) polishing can assist in the elimination of high spots of certain metallic materials from a work piece. The oxidation product can then be mechanically wiped from the interface surface. In one aspect, an electrical bias is introduced across the metal polishing tool which causes oxidation of materials contacted by the metal pad. Due to this contact-specific oxidation, only the high points of the metallic material on the work piece is oxidized. This process may be particularly useful for polishing copper traces or other conductive structures.

In another aspect of the present invention, the polishing tool may be an organic polishing tool. Examples of organic materials useful in the construction of such polishing tools may include various polymeric materials. Such materials may include, without limitation, urethanes, carbonates, amides, sulfones, vinyl chlorides, acrylates, methacrylates, vinyl alcohols, esters, acrylamide moieties, or combinations thereof. In one aspect, the nano-diamond is impregnated in a polymeric material. In a further embodiment, the nano-diamond is dispersed in Polytetrafluoroethylene (PTFE), generally known as Teflon®. Further discussion of organic polishing tools can be found in U.S. Pat. No. 6,022,268, which is hereby incorporated by reference.

The polishing tools according to various aspects of the present invention can be used for polishing applications with or without abrasive particles. As such, in one aspect a work piece may be polished in the absence of abrasive particles. In these cases, polishing occurs due to the movement of the tips of the asperities across the surface being polished. Such abrasive-free polishing may be assisted by chemical slurries, electrolytic reactions, etc. In another aspect, however, nano-abrasive particles may be included to increase the rate of the polishing of the work piece. Such nano-abrasive particles may be included into the polishing tool itself, or they may be externally applied prior to or during the polishing operation. In one specific aspect, for example, a slurry having nano-abrasive particles may be applied to the working surface of the polishing tool or to the interface surface of the work piece. In another aspect, nano-abrasive particles may be disposed within at least a portion of the working surface, along with the nano-diamond, of the polishing tool as an impregnated composite material. These particles may be mixed with or otherwise included in the material used to construct the polishing tool during manufacture. In order to disperse the nano-diamond alone or nano-diamond and other nano-abrasive particles uniformly within the matrix material, abrasive particles may be pre-coated with a coupling agent that is wetable by the matrix material. Thus the nano-diamond and nano-abrasive particles would be located at the tips of the asperities, and thus may increase the polishing action of the tool. As the tool wears, further nano-diamond and nano-abrasive particles may be exposed, thus further assisting the polishing operation. In yet another embodiment, the nano-diamond alone or nano-diamond and other nano-abrasive particles may be affixed to the working surface of the polishing tool prior to or following the formation of the asperities.

Although any nano-abrasive particle capable of assisting in the polishing of a work piece would be considered to be within the scope of the claims of the present invention, specific examples may include, or consist of, diamond, boron carbide, cubic boron nitride, garnet, silica, ceria, alumina, zircon, zirconia, titania, manganese oxide, copper oxide, iron oxide, nickel oxide, silicon carbide, silicon nitride, tin oxide, titanium carbide, titanium nitride, tungsten carbide, yttria, and mixtures thereof. Additionally, various other ceramic materials may be utilized as nanoabrasive particles. In one specific aspect, the nano-abrasive particles may include or consist of nano-diamond particles. Additionally, although nano-abrasive particles have been primarily discussed in relation to the polishing tools of the various aspects disclosed herein, it should be understood that for particular applications micron-sized abrasive particles may be used, and should be included within the present scope.

Regarding truing the working surface of a substrate, the present invention is meant to include taking a pre-trued substrate and forming asperities thereon. A tool having a trued surface may be purchased in the trued state, or may be obtained through other means. Therefore, any means of truing a surface of a nano-diamond impregnated substrate is to be included in the present invention.

The following examples present various methods for making the coated superabrasive particles and tools of the present invention. Such examples are illustrative only, and no limitation on present invention is meant thereby.

EXAMPLES

Example 1

Figure 5:
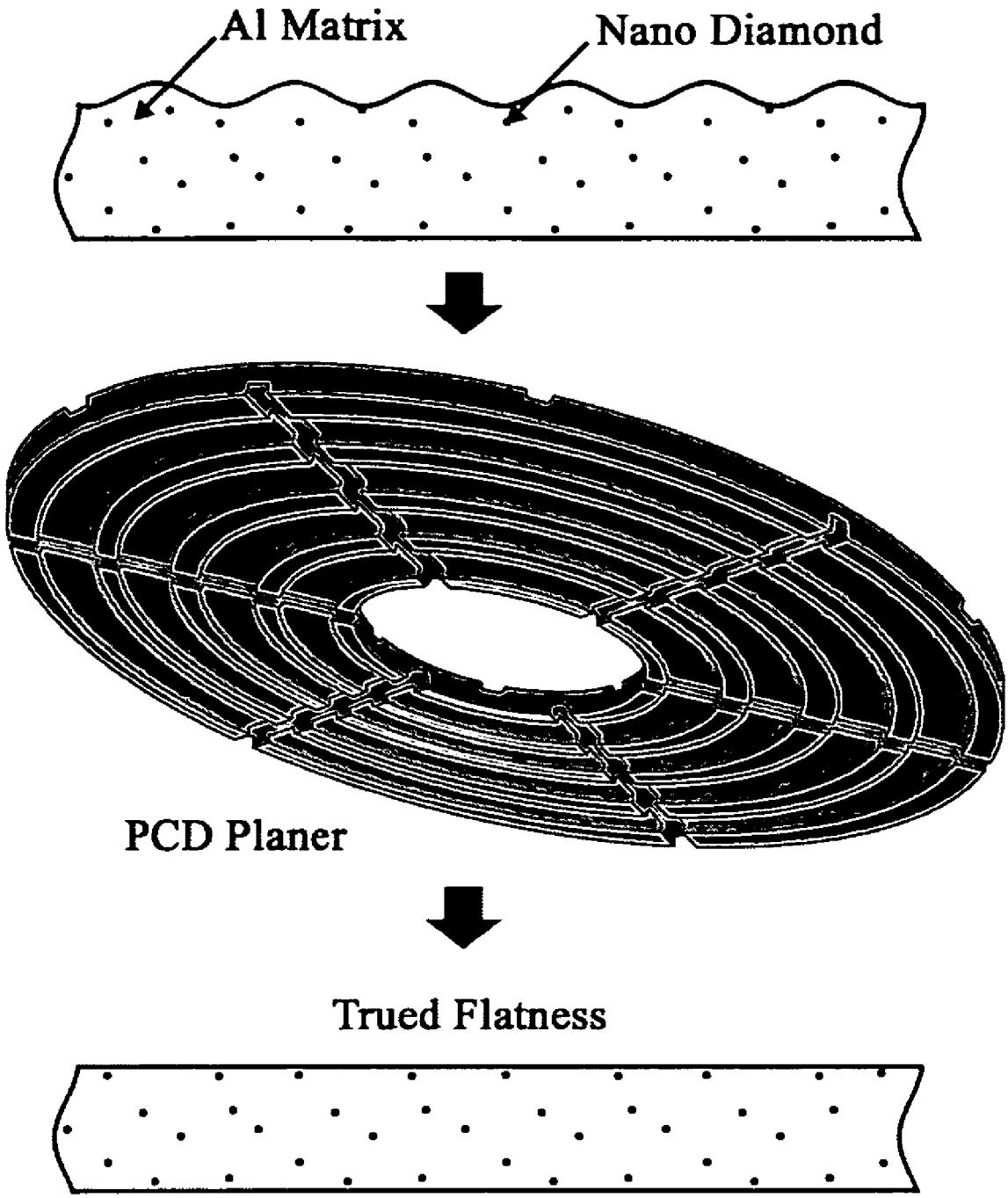
FIG. 5 is a depiction of truing the surface of a work piece in accordance with a further aspect of the present invention.
Figure 6:
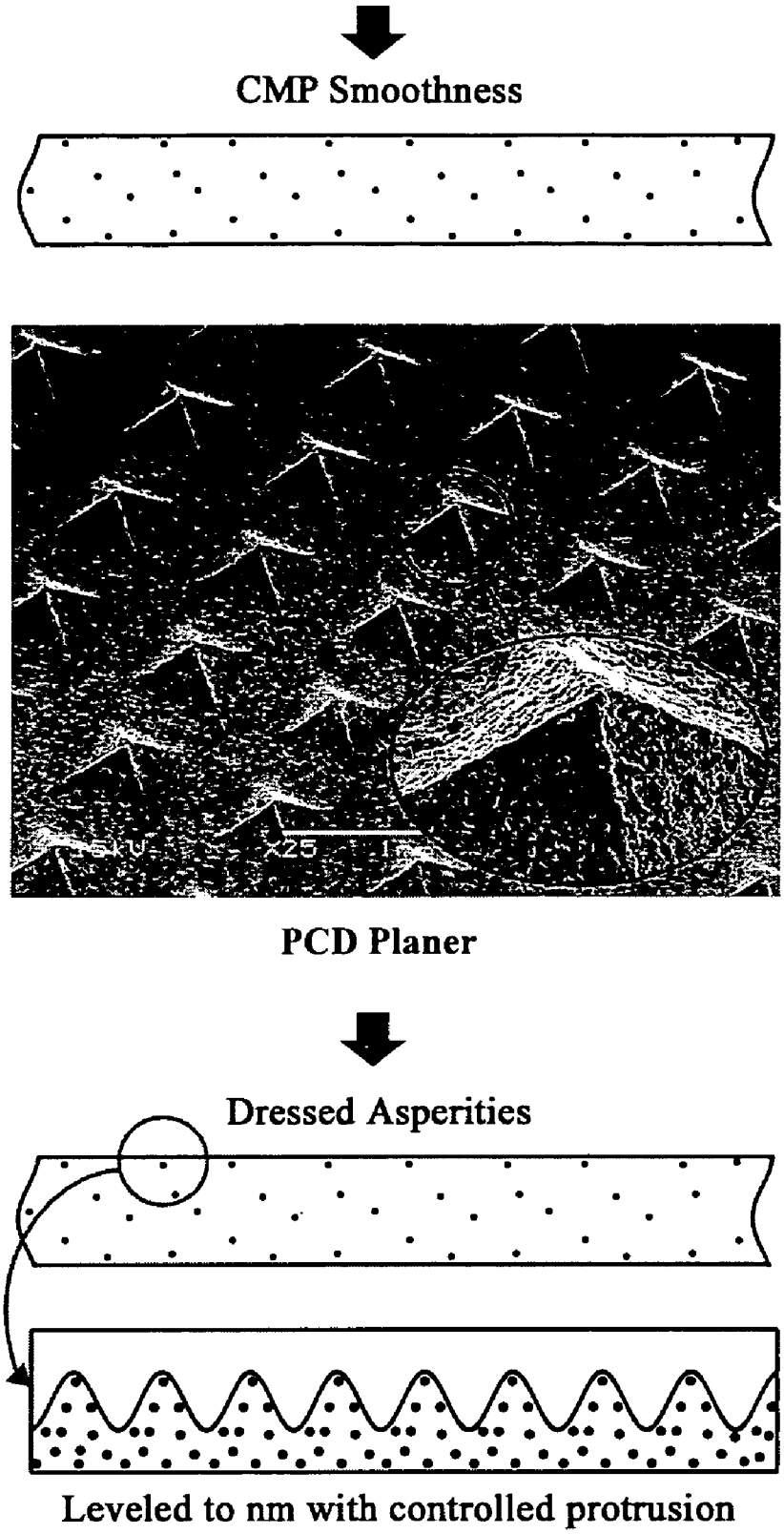
FIG. 6 is a depiction of dressing the surface of a work piece in accordance with yet a further aspect of the present invention.

Nano-diamond particles of Tomei PM powder (50 nm) are mixed in with Al powder and melted in vacuum to form a mixture. The mixture is diluted with agitation in a pool of molten Al—Si alloy under protected atmosphere. The resulting alloy is cast to form a thin flat layer that is rolled to a uniform thickness. The layer is then cut to form a circular disk. The disk is mounted on a rotating platen and trued with a PCD planer to a roughness (RA) of less than 5 microns. FIG. 5 shows a depiction of a starting surface (top), a PCD planer (middle), and a final trued surface (bottom). A PCD dresser is used to create uniform asperities of about 10 microns. FIG. 6 shows a depiction of a starting surface (top), a PCD dresser (middle), and a dressed surface (bottom). This textured pad is used to polish a silicon wafer to a mirror finish of 3 nm RA.

Example 2

A stainless steel sheet is flattened and mounted on a rotating platen. The surface is trued with a PCD planer and subsequently dressed with a PCD dresser to create uniform asperities of about 10 microns. This textured steel pad is used to polish a copper coated print circuit board to achieve mirror finish of 1 micron RA.

Of course, it is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A method of making a polishing tool comprising:

truing a working surface of a nano-diamond impregnated substrate;

forming asperities on the working surface with a polycrystalline diamond dresser, such that the asperities have a height to distance ratio of from about 1:5 to about 5:1, and wherein average asperity diameter is less than about 175 μm.

2. The method of claim 1, wherein truing the working surface further includes shaving the working surface with a planer.

3. The method of claim 2, wherein the planer is a polycrystalline diamond planer.

4. The method of claim 1, wherein the height to distance ratio is from about 1:2 to about 2:1.

5. The method of claim 4, wherein the height to distance ratio is about 1:1.

6. The method of claim 1, wherein the average asperity diameter is less than about 150 μm.

7. The method of claim 6, wherein the average asperity diameter is less than about 125 μm.

8. The method of claim 7, wherein the average asperity diameter is less than about 100 μm.

9. The method of claim 1, wherein the nano-diamond comprises less than about 50% of the substrate.

10. The method of claim 9, wherein the nano-diamond comprises less than about 25% of the substrate.

11. The method of claim 10, wherein the nano-diamond comprises less than about 10% of the substrate.

12. The method of claim 1, wherein the nano-diamond impregnated substrate includes a member selected from the group consisting of organic materials, inorganic materials, and mixtures thereof.

13. The method of claim 12, wherein the nano-diamond impregnated substrate includes an organic material.

14. The method of claim 13, wherein the nano-diamond impregnated substrate includes the organic material selected from the group consisting of urethanes, carbonates, amides, sulfones, vinyl chlorides, acrylates, methacrylates, vinyl alcohols, esters, acrylamide moieties, and mixtures thereof.

15. The method of claim 12, wherein the nano-diamond impregnated substrate includes an inorganic material.

16. The method of claim 13, wherein the nano-diamond impregnated substrate includes the inorganic material selected from the group consisting of Al, Cu, Zn, Ga, In, Sn, Ge, Pb, Tl, Cd, Ag, Au, Ni, Pd, Pt, Co, Fe, Mn, W, Mo, Cr, Ta, Nb, V, Sr, Ti, Si, and mixtures thereof.

17. The method of claim 1, further comprising disposing nano-abrasive particles within the working surface of the substrate.

18. The method of claim 17, wherein the nano-abrasive particles include a member selected from the group consisting of diamond, boron carbide, cubic boron nitride, garnet, silica, ceria, alumina, zircon, zirconia, titania, manganese oxide, copper oxide, iron oxide, nickel oxide, silicon carbide, silicon nitride, tin oxide, titanium carbide, titanium nitride, tungsten carbide, yttria, and mixtures thereof.

19. The method of claim 1, wherein the nano-diamond impregnated substrate is comprised of at least about 50% metal.

20. The method of claim 19, wherein the nano-diamond impregnated substrate is comprised of at least about 75% metal.

21. The method of claim 1, wherein the step of truing a working surface comprises obtaining a nano-diamond impregnated substrate that is pre-trued.

* * * * *